US009416538B2

(12) United States Patent
Torres et al.

(10) Patent No.: US 9,416,538 B2
(45) Date of Patent: Aug. 16, 2016

(54) SKIRT PANEL

(71) Applicant: Jacuzzi Inc., Chino, CA (US)

(72) Inventors: Raymond C. Torres, Moreno Valley, CA (US); Hong Charles Li, Peachtree City, GA (US)

(73) Assignee: Jacuzzi Inc., Chino, CA (US)

( * ) Notice: Subject to any disclaimer, the term of this patent is extended or adjusted under 35 U.S.C. 154(b) by 820 days.

(21) Appl. No.: 13/667,212

(22) Filed: Nov. 2, 2012

(65) Prior Publication Data

US 2013/0117925 A1 May 16, 2013

Related U.S. Application Data

(60) Provisional application No. 61/554,624, filed on Nov. 2, 2011, provisional application No. 61/595,711, filed on Feb. 7, 2012.

(51) Int. Cl.
*E04B 2/00* (2006.01)
*A47K 3/16* (2006.01)

(52) U.S. Cl.
CPC . *E04C 2/44* (2013.01); *A47K 3/161* (2013.01); *Y10T 29/49826* (2015.01)

(58) Field of Classification Search
CPC ..... E04C 2/44; A47K 3/161; A47K 3/1615
USPC ..... 4/584, 592, 593
See application file for complete search history.

(56) References Cited

U.S. PATENT DOCUMENTS

| | | | |
|---|---|---|---|
| 3,009,725 | A | 11/1961 | Koch |
| 4,669,133 | A | 6/1987 | Blecher et al. |
| 4,815,685 | A | 3/1989 | Roberts et al. |
| 4,889,209 | A | 12/1989 | Sears |
| 5,208,924 | A | 5/1993 | Smith et al. |
| 5,425,205 | A | 6/1995 | Ha |
| 5,864,898 | A | 2/1999 | Knapp et al. |
| 5,940,906 | A | 8/1999 | Halloran |
| 5,975,664 | A | 11/1999 | Banicevic et al. |
| 6,464,312 | B1 | 10/2002 | Tenhundfeld et al. |

FOREIGN PATENT DOCUMENTS

JP 07331858 A * 12/1995

* cited by examiner

*Primary Examiner* — Tuan N Nguyen
(74) *Attorney, Agent, or Firm* — The Webb Law Firm

(57) ABSTRACT

Attachable and reattachable panels, particularly for water enclosing units, protect, enclose and/or cover an area such as a bathroom, steam room, shower, shower stall, bathtub, whirlpool bath, spa or the like. The panels include a clip assembly associated therewith for removably securing the panels in position and/or to other structural members. The clip assembly includes a male member and a female member, where the female member is configured for receiving the male member.

29 Claims, 10 Drawing Sheets

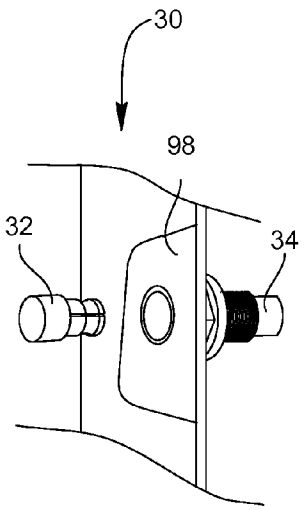
Fig. 9A
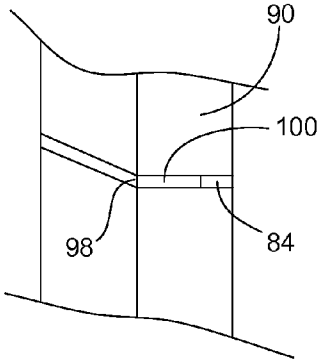
Fig. 9B
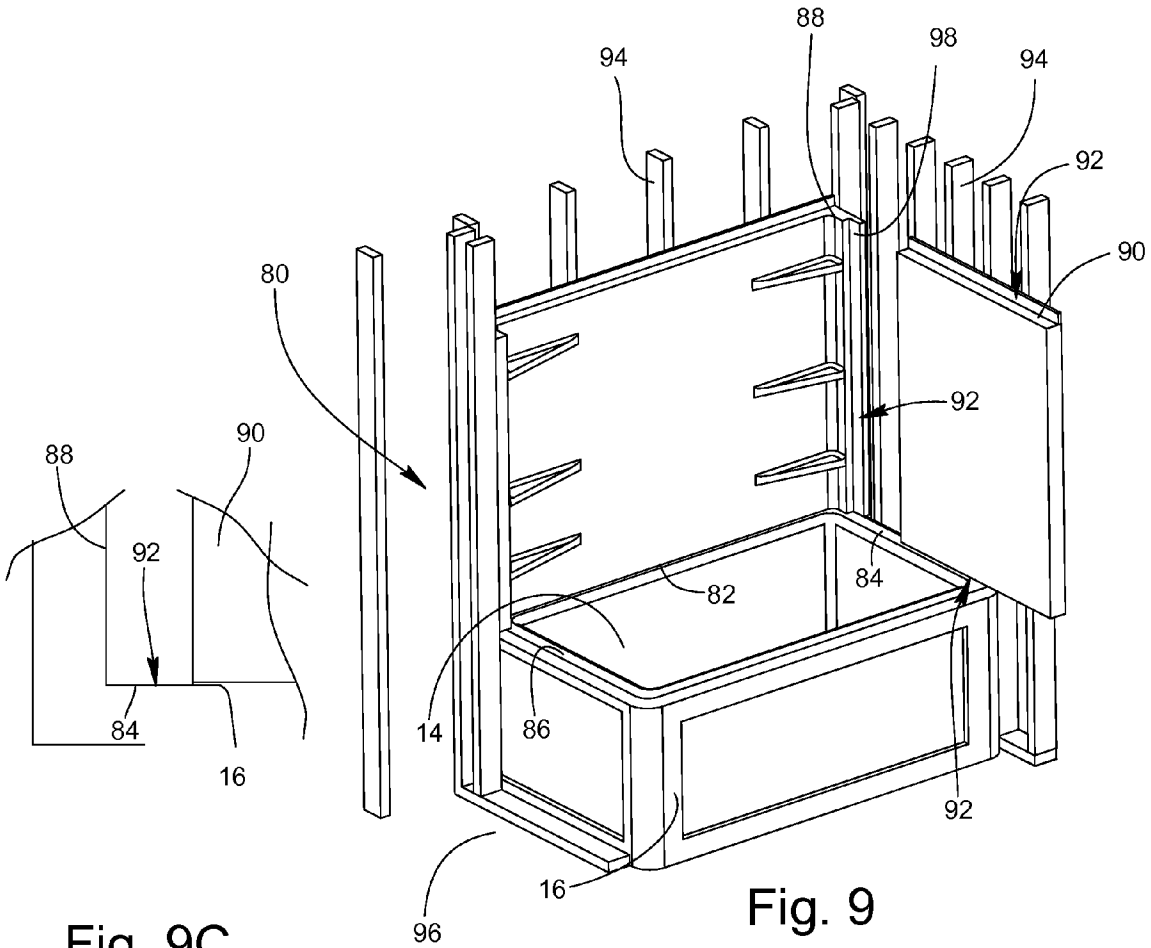
Fig. 9
Fig. 9C

SKIRT PANEL

CROSS-REFERENCE TO RELATED APPLICATIONS

The present application claims priority to U.S. Provisional Patent Application No. 61/554,624, filed Nov. 2, 2011, entitled "Skirt Panel" and U.S. Provisional Patent Application No. 61/595,711, filed Feb. 7, 2012, entitled "Skirt Panel". The entire disclosure of these applications is incorporated by reference herein.

BACKGROUND OF THE INVENTION

1. Field of the Invention

The present invention relates to attachable and reattachable panels, particularly for water enclosing units, which are used to protect, enclose and/or cover an area such as a bathroom, steam room, shower, shower stall, bathtub, whirlpool bath, spa or the like. The present invention also relates to removable skirt panels, particularly for water enclosing units, that are used to enclose and/or cover a contained area containing equipment, wherein the panels are easily removed for easy access to the equipment. The present invention relates to hinged doors which are secured to a doorframe for water enclosing units. Additionally, the present invention relates to wall panels for use with water enclosing units.

2. Description of Related Art

Skirt panels for bathing fixtures and whirlpools are commonly used to hide unattractive space that encloses the mechanical parts of the fixture and plumbing. The facade of a bathtub typically provides a very plain, clean appearance. In some instances, a more decorative look for the front of the bathing fixture may be desirable. As a result, tub skirts have been provided with accessible openings. Hinged doors for bathing fixtures and whirlpools are commonly used to ingress and egress the interior space of the bathing units. Such hinged doors are especially useful for users that have difficulty navigating steps. Kits for forming aesthetically pleasing water enclosing units including back wall portions for the unit are also available. These kits often include multiple components that can be difficult to install.

There have been proposed various joining structures and fixtures for attaching skirt panels to bathing units. U.S. Pat. No. 4,669,133 describes aprons for bathtubs that use a suction cup. The suction cup does not allow for secure alignment and has no easily accessible opening for access to any equipment located behind it. U.S. Pat. Nos. 5,940,906 and 5,864,898 disclose a skirt frame with a detachable panel that is held in place with hook and loop tabs, also known as Velcro®. However, regular access to the opening eventually causes the hook and loop tabs to collect debris which interferes with the secured fastening and alignment of the panel. U.S. Pat. No. 5,208,924 discloses a skirt frame and mechanically attachable panel that employs screws with caps. However, this does not provide easy access and, eventually, due to the plastic composition of the panels and frames, the threading for the screws can become stripped. U.S. patent application Ser. No. 12/396,001, entitled "Removable Skirt Panel", owned by the assignee of the present invention and which is incorporated by reference in its entirety, teaches a series of magnets for creating a magnetic attraction between the panel and the frame of the bathing unit and between the door and the frame of a walk-in type unit.

Accordingly, there is a need for an improved, low-cost apron assembly which allows for easy access to the plumbing equipment contained within the water enclosing unit. There is a further need for a simple, low-cost adjustable latch system that adequately secures the door of a water containment unit during use of the unit while compensating for manufacturing tolerances of the various components. There is also a need for a kit for installing aesthetically pleasing water enclosing units which are formed from a minimum number of components and are easy to install.

SUMMARY OF THE INVENTION

According to a first aspect, the invention is directed to a water enclosing unit that may include a basin for holding water, a skirt, at least one access opening extending through the skirt, a frame defining the access opening, a panel section configured to cooperate with the frame to cover the access opening, and at least one clip assembly affixed to at least one of the frame and the panel section. The clip assembly is adapted to removably secure the panel section to the frame and cover the access opening. The at least one clip assembly can include a series of clip assemblies. The clip assembly can include a male member associated with the panel section and a female member associated with the frame, wherein the female member is configured for receiving the male member to secure the panel section to the frame. The clip assembly can further include a base having a first face, a second face, and an aperture extending therethrough, and the female member can include a tubular receiving member extending through the aperture. The tubular receiving member can have a front portion positioned adjacent to a first surface of the base and a second portion extending through the aperture and adjacent the second surface of the base. The tubular receiving member can include a threaded inner portion and a threaded outer portion. This threaded outer portion is configured for receiving a mounting ring thereon at a location that is adjacent to the second surface of the base. The clip assembly can further include a resilient sleeve located in threaded engagement with the threaded inner portion of the tubular receiving member. The front portion of the tubular member can include a flat stop portion configured for cooperation with the panel section to prevent the panel section from rotating with respect to the clip assembly after mating of the male member with the female member. According to one embodiment, the panel section can have a predetermined thickness, and the frame can include a recessed portion configured to receive the predetermined thickness of the panel section, such that a front face of the panel section forms a flush surface with an outer surface of the skirt. According to a further design, the at least one edge portion of the panel section can include at least one recessed passageway configured to receive an opening member to allow for removal of the panel member from the frame. The unit can include plumbing and/or electrical equipment wherein the skirt covers at least a portion of the plumbing equipment, and the at least one access opening extends through the skirt to allow access to the plumbing and/or electrical equipment.

According to another aspect, the invention is directed to a removable panel for closing an open portion extending through an enclosure skirt wherein the open portion is defined by a frame. The panel includes a planar member having a front face defined by front edge portions and a back face defined by back edge portions. At least one clip assembly is associated with the frame and the planar member. The at least one clip assembly is configured for removably securing the planar member to the frame to cover the open portion. According to one embodiment, the at least one clip assembly can include a series of clip assemblies. The clip assembly includes a male member associated with the planar member and a female member associated with the frame. The female member is configured for receiving the male member to secure the planar member to the frame. The at least one clip assembly can include a flat stop portion configured for cooperation with the planar member to prevent the planar member from rotating with respect to the clip assembly after attachment of the planar member to the frame.

According to yet another aspect, the invention is directed to a readily accessible bathing fixture enclosure, including plumbing equipment contained therein, and a skirt for covering the plumbing equipment. The enclosure includes a frame member defining an open section extending through the skirt, a panel section configured for cooperating with the frame member and covering the open section, and at least one clip assembly associated with the panel section and the frame member, to removably secure the panel section to the frame member.

According to another aspect, the invention is directed to a method for removably closing an access opening of a water enclosing unit. The method includes the step of providing a frame member defining the access opening, providing a panel section configured for cooperating with the frame member for closing the access opening, and associating at least one clip assembly to the frame member and the panel section. The clip assembly is configured for mating together to removably secure the panel section to the frame and cover the access opening. The clip assembly can include a male member and a female member, and wherein the method includes securing the male member to the panel section and securing the female member with the frame. The female member is configured for receiving the male member to secure the panel section to the frame. The method can further include providing the at least one clip assembly with a flat stop portion configured for cooperation with the panel section to prevent the panel section from rotating with respect to the clip assembly after attachment of the panel section to the frame.

According to still another aspect of the invention, there is provided a water enclosing unit having a door securing system wherein the water enclosing unit includes at least one opening allowing for ingress into and egress from an interior portion of the water enclosing unit. A frame defines the at least one opening, and at least one door is hingedly attached to the frame for closing the opening. The securing system includes at least one clip assembly associated with the frame and the door. This clip assembly is configured for mating engagement to removably secure the door in a closed position.

According to yet another aspect, the invention is directed to a water enclosing unit including a basin for holding water, a back panel, at least one side panel configured to cooperate with said back panel, and at least one clip assembly affixed to at least one of the back panel and the side panel, the at least one clip assembly adapted to removably secure the side panel to the back panel to form an aesthetically pleasing unit. The at least one clip assembly can include a series of clip assemblies. The clip assembly can include a male member associated with the side panel and a female member associated with the back panel, wherein the female member is configured for receiving the male member to secure the side panel to the back panel. The clip assembly can further include a base having a first face, a second face, and an aperture extending therethrough and the female member can include a tubular receiving member extending through the aperture. The tubular receiving member can have a front portion positioned adjacent to a first surface of the base and a second portion extending through the aperture and adjacent the second surface of the base. The tubular receiving member can include a threaded inner portion and a threaded outer portion, and, the threaded outer portion can be configured for receiving a mounting ring thereon at a location that is adjacent the second surface of the base. The clip assembly further includes a resilient sleeve located in threaded engagement with the threaded inner portion of the tubular receiving member. According to one design, the front portion of the tubular member can include a flat stop portion configured for cooperation with the back panel to prevent the back panel section from rotating with respect to the clip assembly after mating of the male member with the female member. The side panel section can have a predetermined thickness and the back panel can include a recessed portion configured to receive the predetermined thickness of the side panel such that a front face of the side panel section forms a flush surface with an outer surface of the water enclosing unit. Preferably, at least one edge portion of the side panel can include at least one recessed passageway configured to receive an opening member to allow for removal of the side panel from the back panel. The invention may further include at least one access opening extending through a portion of the unit to allow for access to any plumbing and/or electrical equipment contained therein and wherein the unit includes at least one skirt to cover at least a portion of the plumbing equipment and the at least one access opening. The skirt may include at least one clip assembly.

According to another aspect, the invention is directed to a removable panel for attaching to a support member. The panel includes a planar member having a front face, a back face, and at least one side edge portion. At least one clip assembly is associated with the support member and the planar member. The at least one clip assembly is configured for removably securing the planar member to the support member. The at least one clip assembly can include a series of clip assemblies. The clip assembly can include a male member associated with the planar member and a female member associated with the support member and wherein the female member is configured for receiving the male member to secure the planar member to the support member. The support member can include at least one support side edge portion. The male member can be associated with the at least one side edge portion of the panel and the female member can be associated with the at least one side edge portion of the support member. Alternatively, the male member can be associated with the at least one side edge portion of the support member and the female member can be associated with the at least one side edge portion of the panel. According to one design, the at least one clip assembly can include a flat stop portion configured for cooperation with the panel section to prevent the panel section from rotating with respect to the clip assembly after attachment of the panel section to the support member.

According to yet another aspect, the invention is directed to a method for removably attaching a panel to a support member including providing a support member; providing a panel section configured for attachment to the support member and associating at least one clip assembly to the support member and the panel section, wherein the at least one clip assembly is configured for removably securing the panel section to the support member. The clip assembly can include a male member and a female member, and wherein the method includes securing the male member to the panel section and securing the female member to the support member wherein the female member is configured for receiving the male member to secure the panel section to the support member. Alternatively, the male member can be secured to the support member and the female member can be secured to the panel section. The method may provide the at least one clip assembly with a flat stop portion configured for cooperation with the panel section to prevent the panel section from rotating with respect to the clip assembly after attachment of the panel section to the support member.

According to another aspect, the invention is directed to a kit for attaching at least one panel section to at least one portion of a water enclosing unit. The kit can include at least one panel section configured to cooperate with at least one portion of the water enclosing unit and at least one clip assembly affixed to at least one of the at least one portion of the water enclosing unit and the panel section. The at least one clip assembly can be adapted to removably secure the panel section to the at least one portion of the water enclosing unit. The clip assembly may include a male member associated with the panel section and a female member associated with the at least one portion of the water enclosing unit. According to an alternative design, the male member can be associated with the at least one portion of the water enclosing unit and the female member can be associated with the panel section. The female member is configured for receiving the male member to secure the panel section to the at least one portion of the water enclosing unit. The at least one panel can include a back wall panel and at least one side wall panel, each configured to cooperate with the at least one portion of the enclosing unit. The at least one portion of the enclosing unit can include a back wall portion and a side wall portion, and wherein the back wall panel is attachable to the at least one side wall panel by means of the clip assembly. According to a further design, the at least one panel may include a back wall panel, a first side wall panel, and a second side wall panel each configured to cooperate with the at least one portion of the enclosing unit, wherein the at least one portion of the enclosing unit include a back wall portion, a first side wall portion, and a second side wall portion and wherein the back wall panel is attachable to the first side wall panel and the second side wall panel by means of the at least one clip assembly. The kit may further include a basin associated with the water enclosing unit. The basin may include a bathtub, a shower, and the like.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures.

BRIEF DESCRIPTION OF THE DRAWINGS

FIG. 9 is a perspective view of a water enclosing unit with a back panel installed and a side panel being installed according to the present invention;

FIG. 9A is an exploded perspective view of the clip assembly of FIG. 9 for securing the back and side panels;

FIG. 9B is an expanded side perspective view of FIG. 9 illustrating the fit between a portion of the water enclosing unit and a panel; and FIG. 9C is an expanded side perspective view of FIG. 9 illustrating a side panel moving along a track for engagement with a back panel of the water enclosing unit.

BRIEF DESCRIPTION OF THE INVENTION

Figure 1:
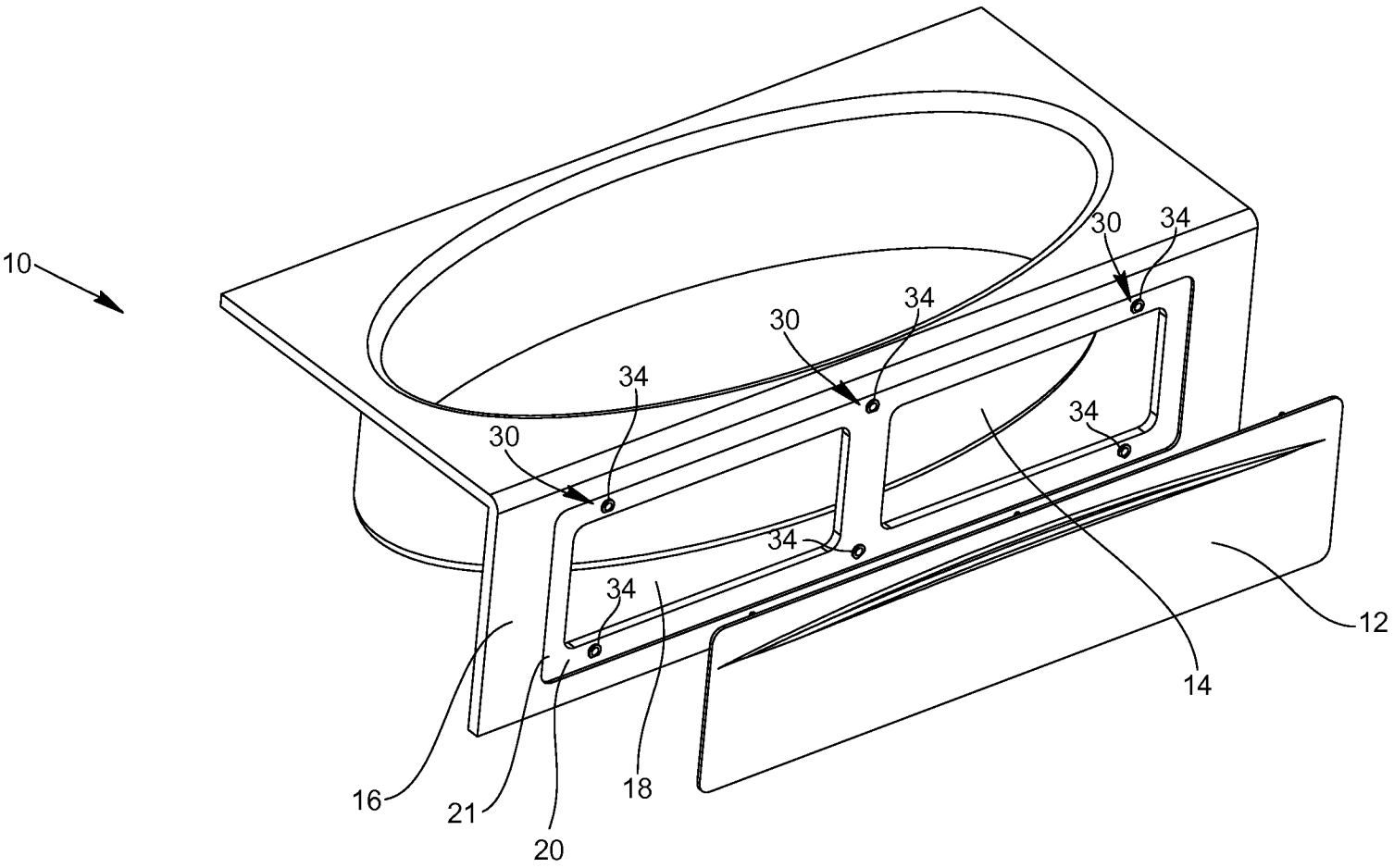
FIG. 1 is a side perspective view of the water enclosing unit including a removable panel according to the invention.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence, specific dimensions and other physical characteristics related to the embodiments disclosed herein are not to be considered as limiting.

Figure 2:
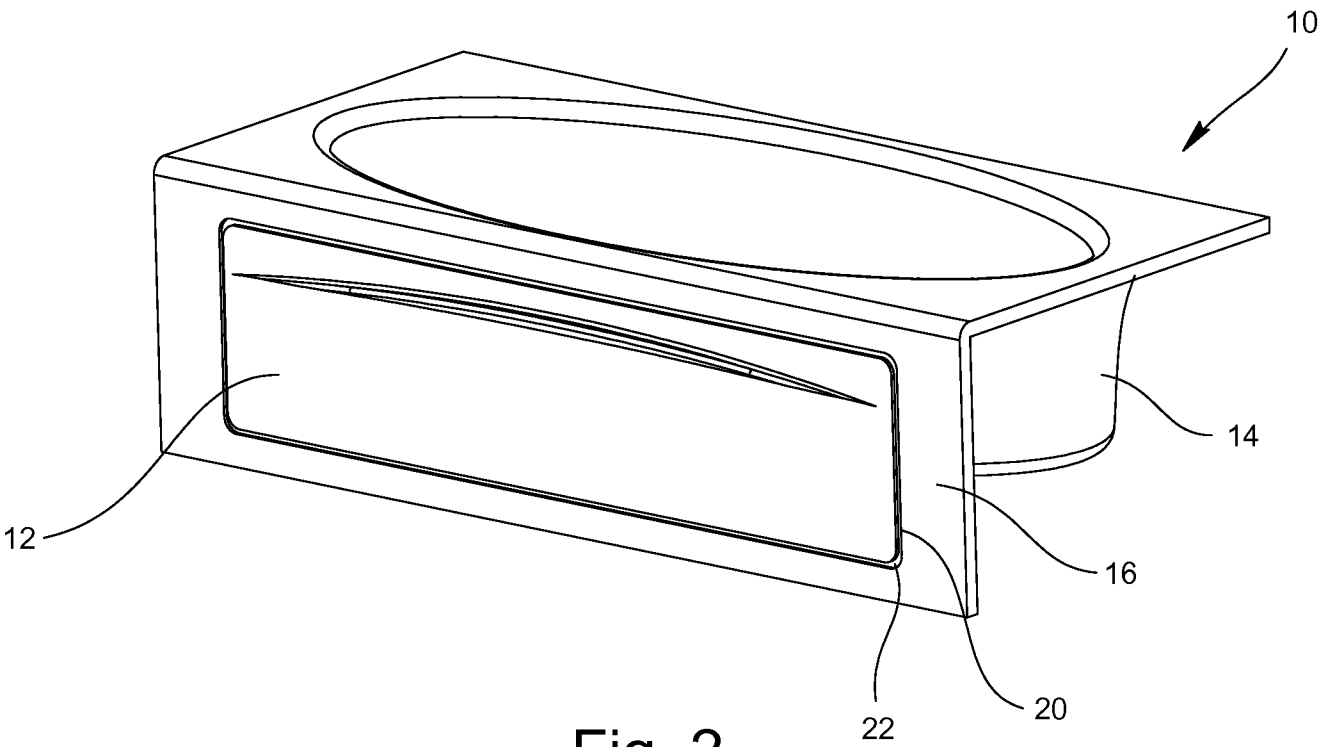
FIG. 2 is a side perspective view of the water enclosing unit of FIG. 1 wherein the removable panel is attached to the water enclosing unit.
Figure 3:
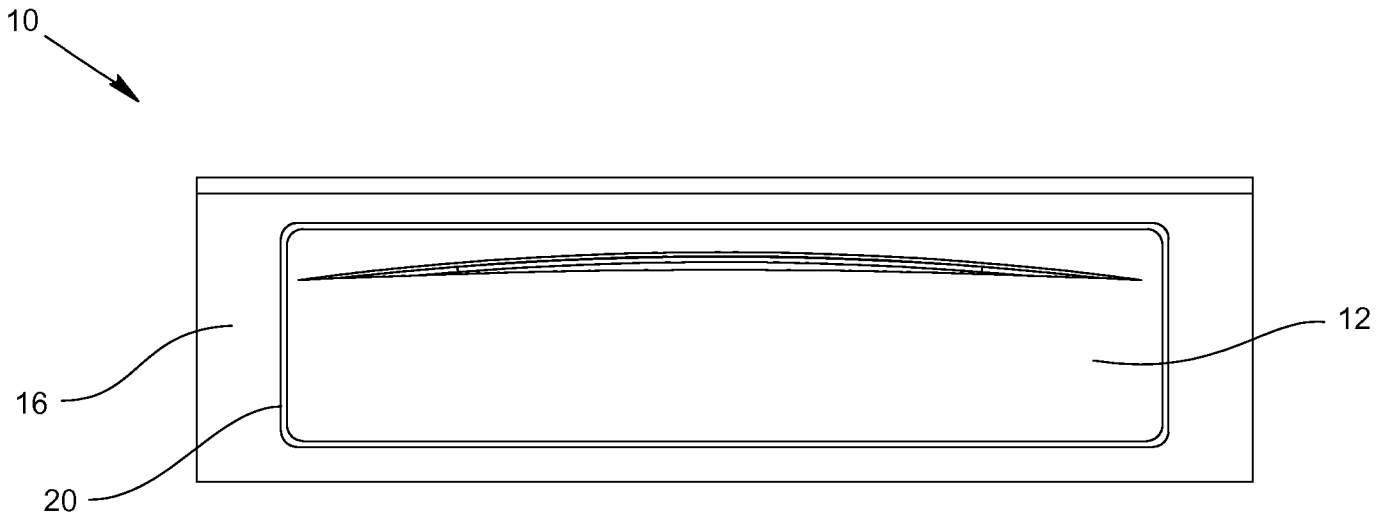
FIG. 3 is a front elevation view of the water enclosing unit of FIG. 2.
Figure 4:
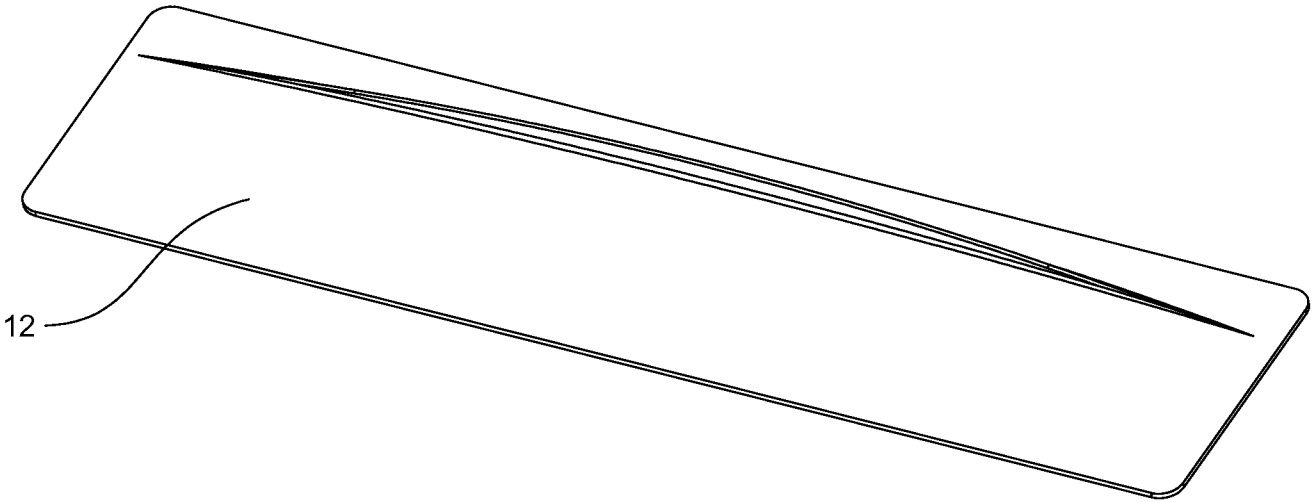
FIG. 4 is a top perspective view of the removable panel which can be secured to a water enclosing unit.

Reference is now made to FIGS. 1-3 which show a water enclosing unit, generally indicated as 10, including a removable panel or panel section 12 as shown in FIG. 4, according to the invention. The water enclosing unit 10 includes a basin 14 for holding water, such as a bathtub, a skirt 16, at least one access opening 18 extending through the skirt, and a frame 20 defining the access opening 18. The removable panel or panel section 12 is configured to cooperate with the frame 20 to cover the access opening 18. It can be appreciated that multiple access openings 18 can exist and multiple panel sections 12 can be provided for covering these access openings 18. For example, the frame 20 may include access openings 18 on the side and back portions of the water enclosing unit 10. A panel section 12 may be provided to cover each of such access openings 18. In some embodiments, the unit can include plumbing and/or electrical equipment (not shown) and the skirt 16 can be provided to cover at least a portion of the plumbing equipment, and the at least one access opening 18 can extend through the skirt 16 to allow access to the plumbing and/or electrical equipment. The removable panel 12 covers this access opening 18 in order to provide an aesthetically pleasing unit.

Reference is now made to FIGS. 5, 5A, 5B and 6-7 which show the at least one clip assembly, generally indicated as 30, which can be affixed to at least one of the frame 20 and the panel section 12. The clip assembly 30 is adapted to removably secure the panel section 12 to the frame 20 and cover the access opening 18. It can be appreciated that the at least one clip assembly 30 can include a series of clip assemblies 30, the number of which depends upon the size of the access opening 18 and the size and shape of the panel section 12 to be secured to the frame 20. It can also be appreciated that the clip assembly 30 illustrated in FIGS. 5, 5A, 5B, and 6-7 may be used with any of the embodiments discussed in the present disclosure. In one embodiment, the clip assembly 30 includes a male member 32 associated with the panel section 12 and a female member 34 associated with the frame 20 wherein the female member 34 is configured for receiving the male member 32 to secure the panel section 12 to the frame 20. The male member 32 includes a first portion with groves 39 for receiving an adhesive or any other type of joining member that secures the male member 32 within an opening 15 in the panel section 12. The male member 32 also includes a second portion for being received within the female member 34. The second portion of the male member 32 may be generally cylindrical with a rounded terminal portion. In one embodiment, the male member 32 includes a depression 33 extending around an outside perimeter of the male member 32. The depression 33 is adapted for cooperating with a resilient sleeve 48 of the female member 34 in a manner described hereafter. One of ordinary skill in the art will appreciate that the male member 32 may be associated with frame 20 and the female member 34 may be associated with the panel section 12.

With continuing reference to FIGS. 5, 5A, 5B and 6-7, one embodiment of the clip assembly 30 further includes a base 36 having a first face 36*a*, a second face 36*b*, and an aperture 36*c* extending therethrough. The female member 34 has a tubular receiving member 38 extending through the aperture 36*c*. The tubular receiving member 38 has a front portion 38*a* positioned adjacent to a first surface 36*a* of the base 36 and a second portion 38*b* extending through the aperture and adjacent the second surface 36*b* of the base 36. The tubular receiving member 38 includes a threaded inner portion 40 and a threaded outer portion 44. The threaded outer portion 44 is configured for receiving a mounting ring 46 thereon at a location that is adjacent the second surface 36*b* of the base 36. In this configuration, the base 36 is disposed between the first portion 38*a* of the tubular receiving member 38 of the female member 34 and the mounting ring 46. The clip assembly 30 further includes the resilient sleeve 48, a portion of which is located in threaded engagement with the threaded inner portion 40 of the tubular receiving member 38. The threaded engagement of the resilient sleeve 48 with the threaded inner portion 40 of the tubular receiving member 38 allows for an adjustment of the position of the resilient sleeve 48 with respect to the threaded inner portion 40. A cap or slot 50 may optionally be provided proximate to the portion of the resilient sleeve 48 that is threadably engaged with the threaded inner portion 40 of the tubular receiving member 38. The cap or slot 50 can be a separate member or can be integrally formed with the resilient sleeve 48. The cap or slot 50 allows for adjusting the position of the resilient sleeve with respect to the threaded inner portion 40 of the tubular receiving member 38. Adjusting the position of the resilient sleeve with respect to the threaded inner portion 40 of the tubular receiving member 38 allows for an adjustment of the panel 12 with respect to the skirt 16, thereby resulting in either a tighter or looser fit of the panel 12 against the water enclosing unit 10 and/or skirt 16.

The resilient sleeve 48 is adapted for receiving the male member 32. The resilient sleeve 48 has a substantially tubular structure with an annular projection 49 extending radially inward at a location proximate to an end of the resilient sleeve 48 that is first engaged by the male member 32. The annular projection 49 is adapted to deflect slightly as the male member 32 first enters the resilient sleeve 48. Further movement of the male member 32 into the resilient sleeve 48 causes the annular projection 49 to engage the depression 33 on the male member 32 to create a secure connection between the male member 32 and the female member 34. In order to disengage the male member 32 from the female member 34, and thereby remove the panel 12 from the skirt 16, the male member 32 is retracted with respect to the female member such that the depression 33 is driven outside the annular projection 49. The resilient sleeve 48 is made from a flexible material that is designed to compensate for manufacturing tolerances and/or deviations in the size of the male member 32 with respect to the hollow interior of the resilient sleeve 48.

Figure 5:
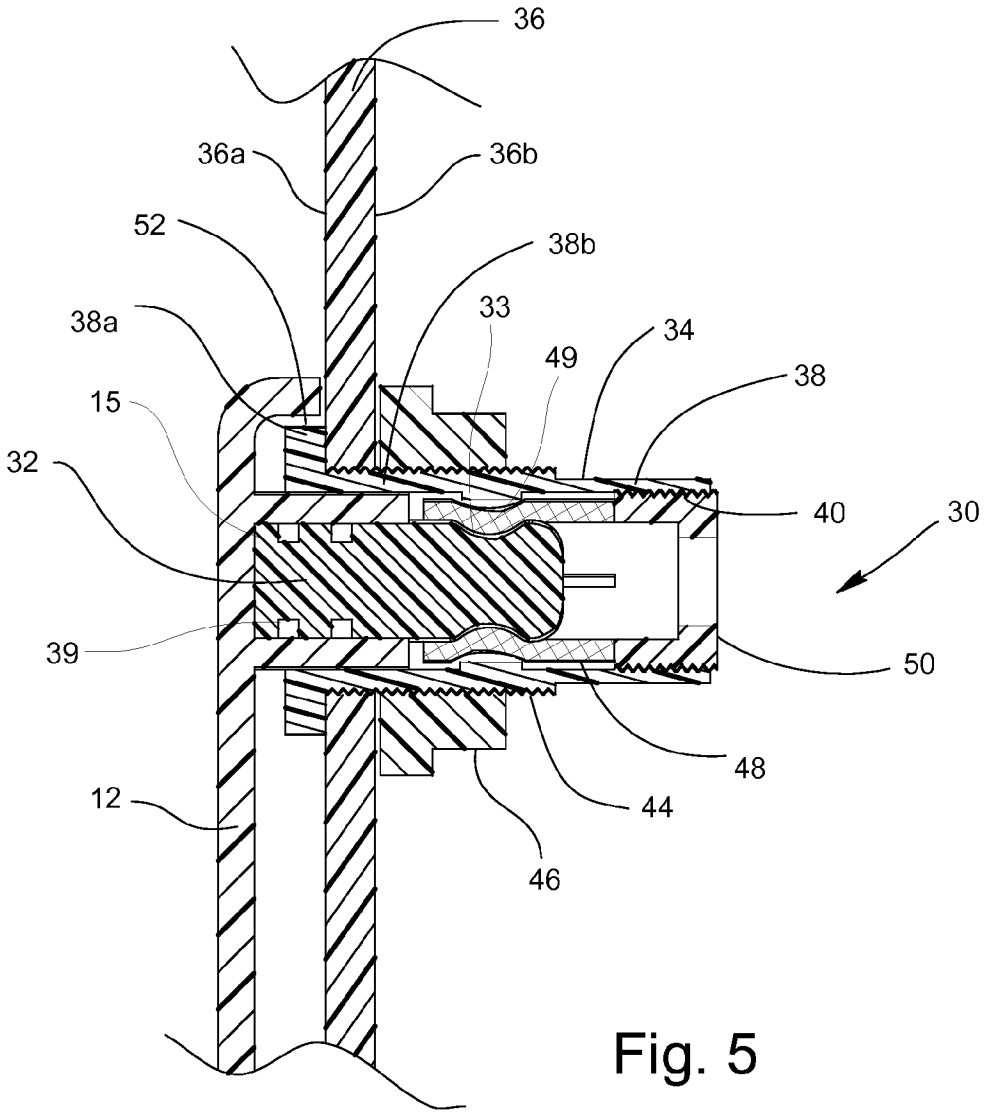
FIG. 5 is a cross-sectional view of the clip assembly for securing the removable panel according to FIG. 1 and taken along line V-V in FIG. 2.
Figure 5A:
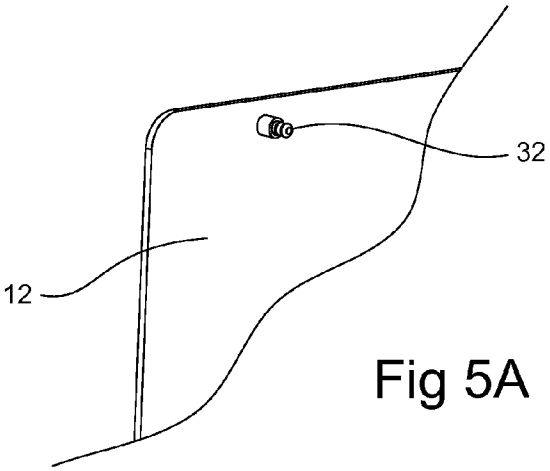
FIG. 5A is a back elevation view portion of the removable panel including the male connection member of the clip assembly.
Figure 5B:
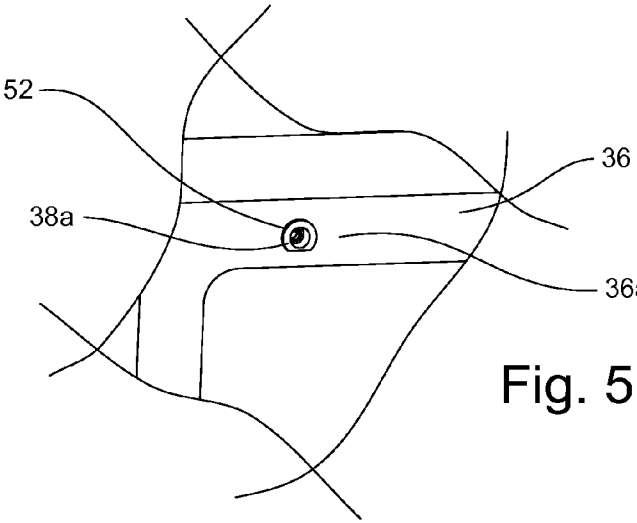
FIG. 5B is a front elevation view of the female connection member of the clip assembly that is configured for mating engagement with the male connection member of FIG. 5A.

With reference to FIGS. 5 and 5B, the front portion 38*a* of the tubular receiving member 38 includes a flat stop portion 52 configured for cooperation with the panel section 12 to prevent the panel section 12 from rotating with respect to the clip assembly 30 after mating of the male member 32 with the female member 34.

Figure 6:
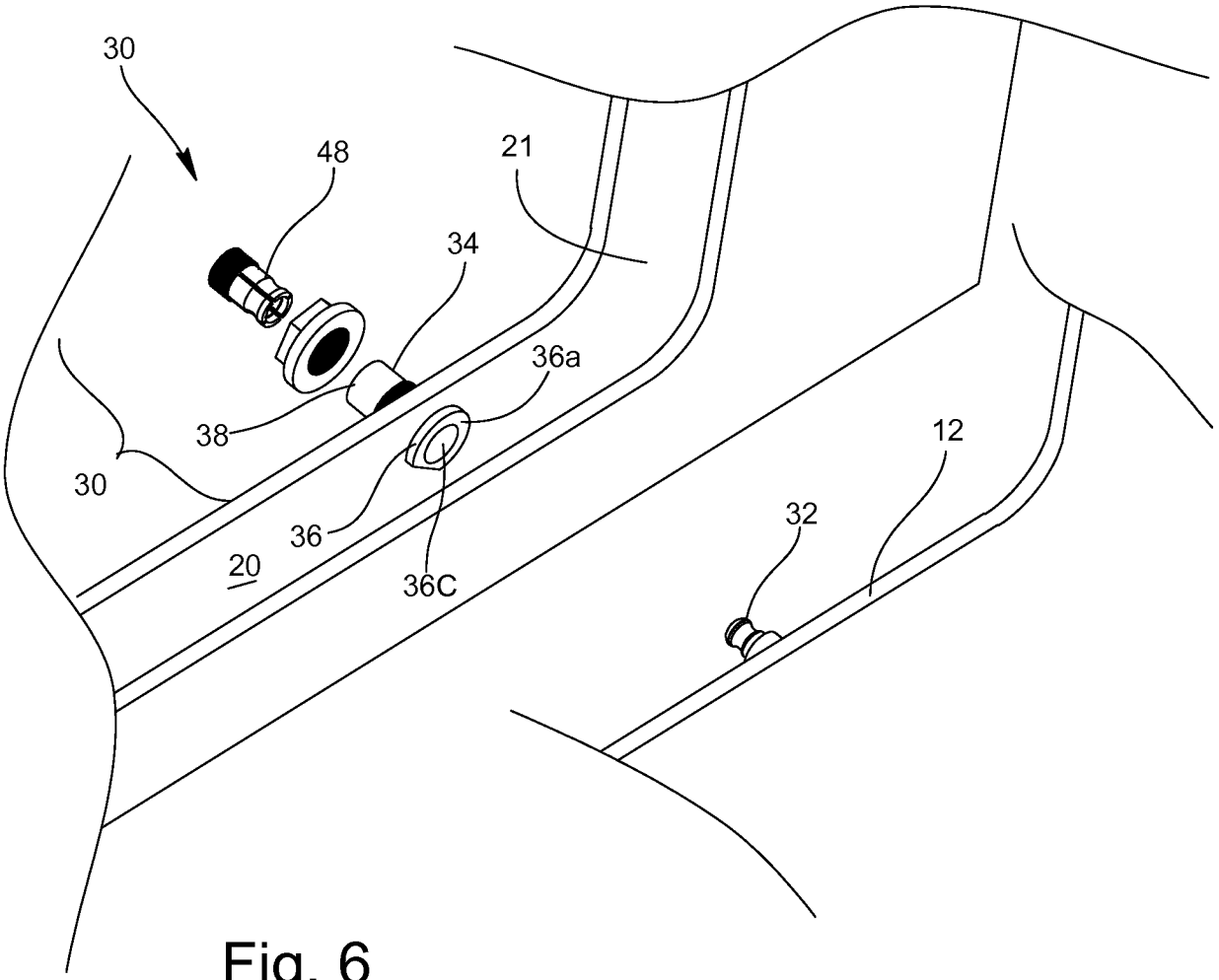
FIG. 6 is a side perspective exploded view of the clip assembly of FIG. 5.
Figure 7:
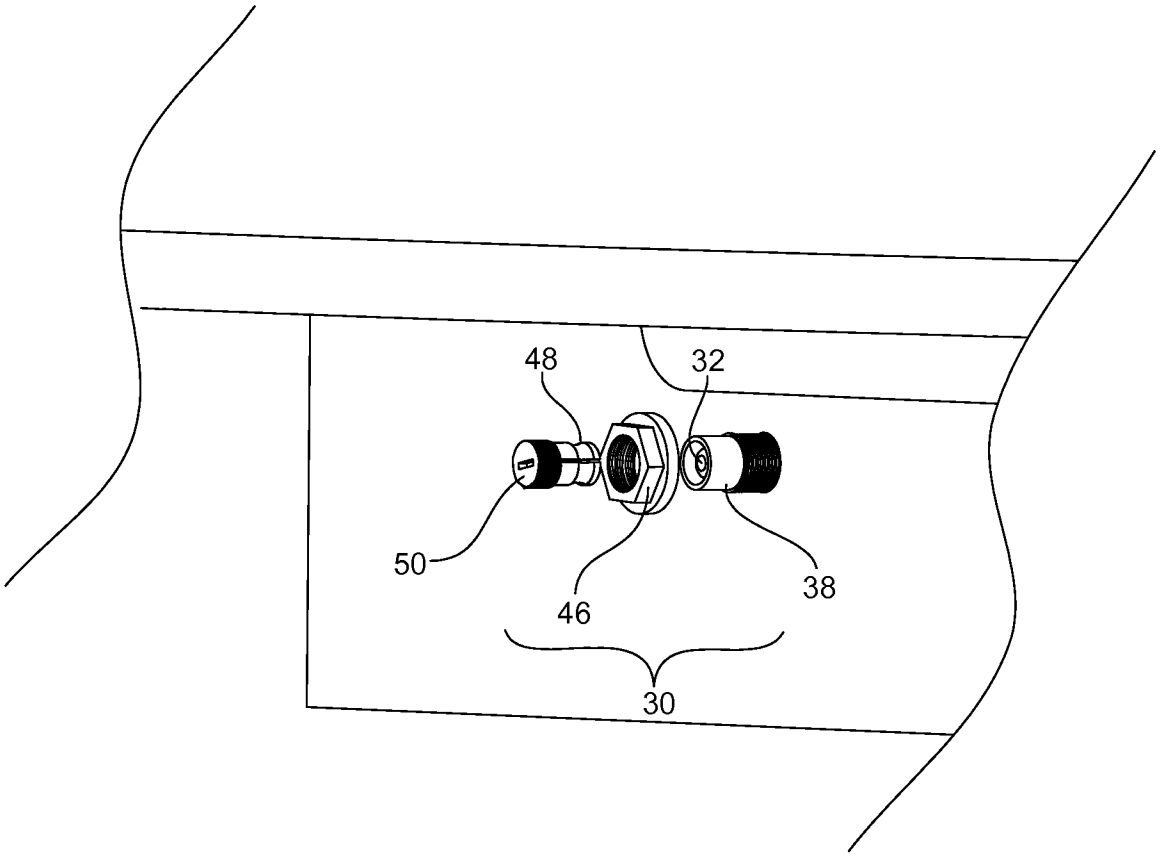
FIG. 7 is a side perspective view of the clip assembly of FIG. 5 in a partially assembled state.

According to one embodiment, the panel section 12 has a predetermined thickness and the frame 20 includes a recessed portion 21, best shown in FIGS. 1 and 6, configured to receive the predetermined thickness of the panel section 12 such that a front face of the panel section forms a flush surface, as shown in FIGS. 2 and 3, with an outer surface of the skirt 16. According to a further design, the at least one edge portion of the panel section includes at least one recessed passageway 22 configured to receive an opening member, such as a tool or a user's hand, to allow for removal of the panel section 12 from the frame 20.

Figure 8:
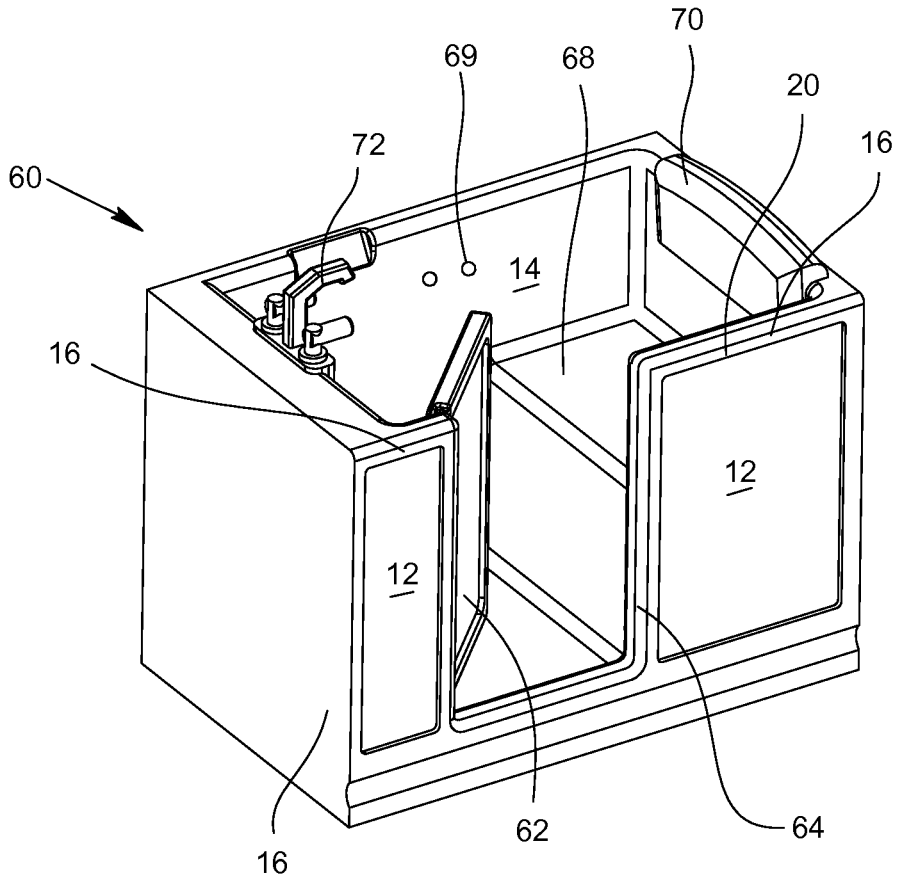
FIG. 8 is a perspective view of a water enclosing unit having a walk-in entrance including the clip assembly of the invention for securing the door.

Reference is now made to FIG. 8 which shows an embodiment of a water enclosing unit, generally indicated as 60. The water enclosing unit 60 shown in FIG. 8 is a left-handed entry walk-in bathtub; however, it is recognized that the present invention is not limited to the design of this particular water enclosing unit 60, but encompasses other types of water enclosing units including whirlpools, hot tubs, treatment spas, and a variety of bathtub designs. A door 62, which can have an aluminum frame, is hingedly secured to a doorframe 64. The door 62 is swingably secured to the doorframe 64 with a hinge (not shown) to allow for either a left or right-handed entry design of the water enclosing unit 60. The door 62 can be secured or closed using the at least one clip assembly of the invention and shown in FIGS. 5, 5A, and 6-7. The clip assembly 30 is associated with the doorframe 64 and the door 62. The clip assembly 30 is configured for mating engagement to removably secure the door 62 in a closed position. It will be appreciated by one skilled in the art that once the water enclosing unit 60 is filled with water, the force of the water held in the water enclosing unit 60 assists in maintaining the door 62 in a closed position.

With continuing reference to FIG. 8, the water enclosing unit 60 in one embodiment includes plumbing equipment and/or electrical equipment (not shown in FIG. 8) which is covered by the skirt 16 and removable panel sections 12. The water enclosing unit shown in FIG. 8 also includes a seat 68, whirlpool jets 69 which provide comfort/treatment to the user, and a head rest 70. Water is supplied by a well-known source, such as a faucet 72. In operation, the door 62 is closed and a person can sit on the seat 68. The water enclosing unit 60 is filled with water which is contained within an interior space or basin 14 defined by the walls of the unit 60. The plumbing equipment can include any type of equipment commonly used in bathtubs or spas, and the removable panel or panel section 12 can be attached by the clip assembly 30, shown in FIGS. 5, 5A, 5B and 6-7.

Hence, the present invention provides for easy removal and replacement of panel sections for accessing plumbing and/or electrical equipment of a water enclosing unit 10, as well as a fluid-tight sealing mechanism for ensuring fluid-tight sealing of the door 62 during use of the unit 60.

It can be appreciated that the clip assembly 30 in the present invention is not limited to the attachment of removable panels for closing of access openings in water enclosing units, but can be used for the attachment of a removable panel for closing any type of open portion extending through an enclosure skirt or wall portion wherein the open portion is defined by a frame.

The present invention is also directed to a method for removably closing an access opening of a water enclosing unit and/or to a method for removably closing any type of opening extending through a skirt or wall wherein access through this opening is desired.

Reference is now made to FIGS. 9-9C which show an embodiment of a water enclosing unit, generally indicated as 80. In various embodiments, the water enclosing unit 80 can be any known unit, including tubs, showers, whirlpools, and the like. The water enclosing unit 80 includes a basin 14, such as a tub, for holding water and a skirt 16. The basin 14 includes an upper back portion 82, a first upper side portion 84, and a second upper side portion 86. The portions 82, 84, and 86 are configured to accommodate the back wall panel 88, the first side wall panel 90 or the second side wall panel (not shown), respectively. It will be appreciated by one having ordinary skill in the art that the back wall panel 88 may be configured to accept the first side wall panel 90 and/or the second side wall panel (not shown). The panels are attachable to each other or to the portions of the water enclosing unit 80 by the clip assembly 30, in a manner shown in FIGS. 5, 5A, 5B and 6-7, located along side edges 98 of the panels. In one embodiment, side edges 98 include indentations 100 to hold clip assemblies so that when assembled, a smooth, finished and aesthetically pleasing enclosure unit is produced. The upper back portion 82, the first upper side portion 84, and the second upper side portion 86 of the water enclosing unit 80 may have tracks, guides, indentations, protrusions, or the like generally illustrated as 92 to aid in aligning the panels on the water enclosing unit 80 and in ultimately aligning male member 32 with the female member 34 of the clip assembly 30. In one embodiment, the male member 32 is associated with the at least one side edge portion 98 of the panel 90 and the female member 34 is associated with the at least one side edge portion 98 of the support member. Alternatively, the male member 32 can be associated with the at least one side edge portion 98 of the support member 94 and the female member 34 can be associated with the at least one side edge portion 98 of the panel 90.

As described previously with reference to FIGS. 5-5B, the clip assembly 30 includes a male member 32 and a female member 34. The method of assembling the panels includes the steps of securing the male member 32 to the panel section 90 and securing the female member 34 to the support member 94 wherein the female member 34 is configured for receiving the male member 32 to secure the panel section 90 to the support member 94. Alternatively, the male member 32 can be secured to the support member 94 and the female member 34 can be secured to the panel section 90.

According to an alternative design, the male member 32 can be associated with the at least one portion of the water enclosing unit 80 and the female member 34 can be associated with the panel section 90. The female member 34 is configured for receiving the male member 32 to secure the panel section 90 to the at least one portion of the water enclosing unit 80.

The clip assembly 30 includes a male member 32 associated with the side panel and a female 34 member associated with the back panel 88, wherein the female member 34 is configured for receiving the male member 32 to secure a side panel 90 to the back panel 88. Additionally, the clip assembly 30 includes a male member 32 associated with a planar member 88 and a female member 34 associated with the support member 94 and wherein the female member 34 is configured for receiving the male member 32 to secure the planar member 88 to the support member 94. Alternatively, the clip assembly 30 may include a male member 32 associated with the at least one panel section 88 and a female member 34 associated with the at least one portion of the water enclosing unit 80, wherein the female member 34 is configured for receiving the male member 32 to secure the at least one panel section 88 to the at least one portion of the water enclosing unit 80. It can be appreciated that the female and male members can be "switched" or alternated. It can also be appreciated that the complementing indentations and protrusions could also be "switched" or alternated.

In one embodiment, the described clip assemblies and panels are set up to form a kit for installing a water enclosing unit with panels. The panels 88, 90 are secured to a frame or studs 94 of a structure and the basin 14 is secured to floor 96 of the structure, such as a home or office, by any suitable technique known in the art. The kit includes at least one panel section 88, 90 configured to cooperate with at least one portion 82, 84, 86 of the water enclosing unit 80 and at least one clip assembly 30 affixed to at least one of the at least one portion 82, 84, 86 of the water enclosing unit 80 and the at least one panel section 88, 90. The at least one clip assembly 30 is adapted to removably secure the at least one panel section 88, 90 to the at least one portion 82, 84, 86 of the water enclosing unit 80. Additionally, the clip assembly 30 includes a male member 32 associated with the at least one panel section 88, 90 and a female member 34 associated with the at least one portion 82, 84, 86 of the water enclosing unit 80. The female member 34 is configured for receiving the male member 32 to secure the at least one panel section 88, 90 to the at least one portion 82, 84, 86 of the water enclosing unit 80. The at least one panel 88, 90 includes a back wall panel 88 and at least one side wall panel 90, each configured to cooperate with the at least one portion 82, 84, 86 of the enclosing unit 80, wherein the at least one portion 82, 84, 86 of the enclosing unit 80 includes a back wall portion 82 and a side wall portion 84, and wherein the back wall panel 88 is attachable to the at least one side wall panel 90 by the clip assembly 30. Additionally, the at least one panel 88, 90 includes a back wall panel 88, a first side wall panel 90, and a second side wall panel (not shown) each configured to cooperate with the at least one portion 82, 84, 86 of the enclosing unit 80, wherein the at least one portion 82, 84, 86 of the enclosing unit 80 includes a back wall portion 82, a first side wall portion 84, and a second side wall portion 86 and wherein the back wall panel 88 is attachable to the first side wall panel 90 and the second side wall panel (not shown) by the at least one clip assembly 30. The kit further includes a basin 14 associated with the water enclosing unit 80, wherein the basin 14 can be a shower, bathtub and the like. It can be appreciated that the kit can be modified or used to install a shower, bathtub unit, whirlpool bath, spa and the like and the enclosure unit can be used to protect, enclose and/or cover an area such as a bathroom, locker room, steam room, spa, or anywhere that moisture or water enclosing is desired.

The present invention has been described with reference to the preferred embodiments. Modifications, combinations and alterations will occur to others upon reading the preceding detailed description. It is intended that the invention be construed as including all such modifications, combinations and alterations.

The invention claimed is:

1. A water enclosing unit comprising:

a basin for holding water;

a back panel;

at least one side panel comprising a planar member having a front face, a back face, and at least one side edge portion, the at least one side panel configured to cooperate with said back panel; and at least one clip assembly associated with the back panel and the side panel, the at least one clip assembly affixed to at least one of the back panel and the side panel, said at least one clip assembly adapted to removably secure said side panel to said back panel, wherein the at least one clip assembly further includes a resilient sleeve located in threaded engagement with a threaded inner portion of a female member configured as a tubular receiving member, wherein the resilient sleeve is adapted to receive a male member and has a tubular structure with an annular projection extending radially inward at a location proximate to an end of the resilient sleeve.

2. The unit of claim 1, wherein the at least one clip assembly comprises a series of clip assemblies.

3. The unit of claim 2, wherein the clip assembly further comprises a base having a first face, a second face, and an aperture extending therethrough and wherein the female member configured as the tubular receiving member extends through the aperture and has a front portion positioned adjacent to a first surface of the base and a second portion extending through the aperture and adjacent the second surface of the base.

4. The unit of claim 3, wherein the female member configured as the tubular receiving member includes a threaded outer portion, and, wherein said threaded outer portion is configured for receiving a mounting ring thereon at a location that is adjacent said second surface of the base.

5. The unit of claim 3, wherein the front portion of the female member configured as the tubular receiving member includes a flat stop portion configured for cooperation with the back panel to prevent said back panel section from rotating with respect to said clip assembly after mating of said male member with said female member configured as the tubular receiving member.

6. The unit of claim 1, wherein the clip assembly comprises the male member associated with one of the side panel and the back panel and the female member configured as the tubular receiving member associated with the other of the back panel and the side panel, wherein the female member configured as the tubular receiving member is configured for receiving the male member to secure the side panel to the back panel.

7. The unit of claim 1, wherein the side panel section has a predetermined thickness and the back panel includes a recessed portion configured to receive said predetermined thickness of said side panel such that a front face of said side panel section forms a flush surface with an outer surface of the water enclosing unit.

8. The unit of claim 1, wherein at least one edge portion of said side panel includes at least one recessed passageway configured to receive an opening member to allow for removal of the side panel from the back panel.

9. The unit of claim 1, including at least one access opening extending through a portion of the unit to allow for access to any plumbing and/or electrical equipment contained therein and wherein said unit includes at least one skirt to cover at least a portion of said plumbing equipment and said at least one access opening.

10. The unit of claim 9, wherein the skirt includes at least one clip assembly.

11. A removable panel for attaching to a support member forming a unit, said panel comprising:

a planar member having a front face, a back face, and at least one side edge portion;

at least one clip assembly associated with a support member and said planar member, said at least one clip assembly configured for removably securing said planar member to said support member, wherein the clip assembly further includes a resilient sleeve located in threaded engagement with a threaded inner portion of a female member configured as a tubular receiving member, wherein the resilient sleeve is adapted to receive a male member and has a tubular structure with an annular projection extending radially inward at a location proximate to an end of the resilient sleeve.

12. The unit of claim 11, wherein the at least one clip assembly comprises a series of clip assemblies.

13. The unit of claim 11, wherein the clip assembly comprises the male member associated with one of the planar member and the support member and the female member configured as the tubular receiving member associated with the other of support member and the planar member and wherein the female member configured as the tubular receiving member is configured for receiving the male member to secure the planar member to the support member.

14. The unit of claim 13, wherein the clip assembly further comprises a base having a first face, a second face, and an aperture extending therethrough and wherein the female member configured as the tubular receiving member extends through the aperture and has a front portion positioned adjacent to the first face of the base and a second portion extending through the aperture and adjacent the second face of the base.

15. The unit of claim 14, wherein the female member configured as the tubular receiving member includes a threaded outer portion, and, wherein said threaded outer portion is configured for receiving a mounting ring thereon at a location that is adjacent said second face of the base.

16. The unit of claim 14, wherein the front portion of the female member configured as the tubular receiving member includes a flat stop portion configured for cooperation with the panel to prevent said panel section from rotating with respect to said clip assembly after mating of said male member with said female member configured as the tubular receiving member.

17. The unit of claim 13, wherein the support member includes at least one support side edge portion.

18. The unit of claim 11, wherein the male member is associated with the at least one side edge portion of the panel and the female member configured as the tubular receiving member is associated with the at least one side edge portion of the support member.

19. The unit of claim 11, wherein the at least one clip assembly includes a flat stop portion configured for cooperation with the planar member to prevent said planar member from rotating with respect to said clip assembly after attachment of said planar member to said support member.

20. The unit of claim 11, wherein the clip assembly further includes a cap or slot, wherein the cap or slot is provided proximate to the resilient sleeve that is threadably engaged with the threaded inner portion of said female member configured as the tubular receiving member.

21. The unit of claim 11, wherein the support member is a tub frame and the planar member is a panel section.

22. A method for removably attaching a panel to a support member, said method comprising the steps of:

providing a support member;

providing a panel section configured for attachment to said support member, the panel section comprising a planar member having a front face, a back face, and at least one side edge portion;

associating at least one clip assembly to said support member and said panel section, said at least one clip assembly configured for removably securing said panel section to said support member, wherein the clip assembly comprises a male member and a female member configured as a tubular receiving member, and wherein the method includes securing the male member to one of the panel section and the support member and securing the female member configured as the tubular receiving member to the other of the support member and the panel section, wherein the female member configured as the tubular receiving member is configured for receiving the male member to secure the panel section to the support member, wherein the clip assembly further includes a resilient sleeve located in threaded engagement with a threaded inner portion of the female member configured as the tubular receiving member, wherein the resilient sleeve is adapted to receive the male member and has a tubular structure with an annular projection extending radially inward at a location proximate to an end of the resilient sleeve.

23. The method of claim 22, further comprising the step of providing the at least one clip assembly with a flat stop portion configured for cooperation with the panel section to prevent said panel section from rotating with respect to said clip assembly after attachment of said panel section to said support member.

24. A kit for attaching at least one panel section to at least one portion of a water enclosing unit, said kit comprising:

at least one panel section, the panel section comprising a planar member having a front face, a back face, and at least one side edge portion, the panel section configured to cooperate with at least one portion of a water enclosing unit; and at least one clip assembly affixed to at least one of the at least one portion of the water enclosing unit and the at least one panel section, said at least one clip assembly adapted to removably secure said at least one panel section to said at least one portion of the water enclosing unit, wherein the at least one clip assembly further includes a resilient sleeve located in threaded engagement with a threaded inner portion of a female member configured as a tubular receiving member, wherein the resilient sleeve is adapted to receive a male member and has a tubular structure with an annular projection extending radially inward at a location proximate to an end of the resilient sleeve.

25. The kit of claim 24, wherein the clip assembly comprises the male member associated with one of the at least one panel section and the at least one portion of the water containing unit and the female member configured as the tubular receiving member associated with the other of the at least one portion of the water enclosing unit and the at least one panel section, wherein the female member configured as the tubular receiving member is configured for receiving the male member to secure the at least one panel section to the at least one portion of the water enclosing unit.

26. The kit of claim 24, wherein the at least one panel comprises a back wall panel and at least one side wall panel, each configured to cooperate with the at least one portion of the enclosing unit, wherein the at least one portion of the enclosing unit comprises a back wall portion and a side wall portion, and wherein the back wall panel is attachable to the at least one side wall panel by means of the clip assembly.

27. The kit of claim 24, wherein the at least one panel comprises a back wall panel, a first side wall panel, and a second side wall panel each configured to cooperate with the at least one portion of the enclosing unit, wherein the at least one portion of the enclosing unit comprises a back wall portion, a first side wall portion, and a second side wall portion and wherein the back wall panel is attachable to the first side wall panel and the second side wall panel by means of the at least one clip assembly.

28. The kit of claim 24, further comprising a basin associated with the water enclosing unit.

29. A clip assembly comprising:

a resilient sleeve located in threaded engagement with a threaded inner portion of a female member configured as a tubular receiving member, wherein the resilient sleeve is adapted to receive a male member and has a tubular structure with an annular projection extending radially inward at a location proximate to an end of the resilient sleeve, wherein the clip assembly is configured to removably attach a panel to a support member forming a unit.

* * * * *